US010804088B1

(12) United States Patent
Goodwin et al.

(10) Patent No.: US 10,804,088 B1
(45) Date of Patent: Oct. 13, 2020

(54) METHODS AND SYSTEM FOR OPTIMIZING ION TRANSMISSION THROUGH A MASS SPECTROMETER

(71) Applicant: Thermo Finnigan LLC, San Jose, CA (US)

(72) Inventors: Michael P. Goodwin, San Jose, CA (US); Michael W. Senko, Sunnyvale, CA (US); Graeme C. McAlister, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 16/426,980

(22) Filed: May 30, 2019

(51) Int. Cl.
*H01J 49/00* (2006.01)
*H01J 49/06* (2006.01)

(52) U.S. Cl.
CPC ..... *H01J 49/062* (2013.01); *H01J 49/005* (2013.01); *H01J 49/067* (2013.01)

(58) Field of Classification Search
CPC ..... H01J 49/005; H01J 49/062; H01J 49/067
See application file for complete search history.

(56) References Cited

U.S. PATENT DOCUMENTS 5,652,427 A 7/1997 Whitehouse et al.
6,528,784 B1 3/2003 Tang et al.
6,753,523 B1 6/2004 Whitehouse et al.
7,230,232 B2 6/2007 Marriott
7,858,926 B1 12/2010 Whitehouse et al.
9,053,916 B2 6/2015 Coon et al.
2012/0049059 A1* 3/2012 Taniguchi ..... H01J 49/424 250/290
2014/0131571 A1* 5/2014 Shimomura ..... H01J 49/0045 250/288

(Continued)

OTHER PUBLICATIONS

Romanov et al., "Threshold Collision-Induced DissociationMeasurements Using a Ring Ion Guide as the Collision Cell in a Triple-Quadrupole Mass Spectrometer", Anal. Chem. 2009, 81, pp. 6805-6812.

(Continued)

*Primary Examiner* — Nicole M Ippolito
*Assistant Examiner* — Sean M Luck
(74) *Attorney, Agent, or Firm* — Thomas F. Cooney

(57) ABSTRACT

A mass spectrometry method comprises: generating ions; directing the ions through an ion optical component within a first chamber having a first vacuum pressure, the ion optical component maintained at a first electrical potential; transferring the ions through an ion guide within a second chamber having a second vacuum pressure less than the first vacuum pressure, the ion guide maintained at a second electrical potential, wherein a difference between the first and second potentials imparts kinetic energy that causes collision-induced ion fragmentation within the second chamber that removes adduct species; and transferring the ions into another ion guide within a third chamber having a third vacuum pressure less than the second vacuum pressure, the other ion guide maintained at a third electrical potential, wherein a difference between the third and second potentials reduces a portion of the imparted kinetic energy of the ions passing into the third chamber.

11 Claims, 6 Drawing Sheets

(56) References Cited

U.S. PATENT DOCUMENTS

2015/0380231 A1* 12/2015 Brown ..... H01J 49/0072
250/282
2019/0172693 A1 6/2019 Gordon et al.

OTHER PUBLICATIONS

Rowan et al., "Attenuation of Polyatomic Ion Interferences inInductively Coupled Plasma Mass Spectrometry by Gas-Phase Collisions", Applied Spectroscopy (1989), vol. 43 (6), pp. 976-980.

* cited by examiner

METHODS AND SYSTEM FOR OPTIMIZING ION TRANSMISSION THROUGH A MASS SPECTROMETER

TECHNICAL FIELD

The present disclosure relates to mass spectrometers and mass spectrometry. More particularly, the present disclosure relates to in-source fragmentation to remove unwanted adducts and other loosely bound species from analyte ions of interest.

BACKGROUND

Over the last two decades, mass spectrometry has made great strides in analyzing protein samples derived from a variety of different sample types. Coupled with electrospray ionization and various separation techniques, thousands of proteins may be identified and quantitated in a single sample. Similar mass spectral analysis techniques may be employed in the qualitative and quantitative analysis of other biomolecules, such as polypeptides, nucleic acids and carbohydrates.

Unfortunately, depending on the type of ion source employed, the ions generated from large analyte molecules often have unwanted adducts or other loosely bound species—such as solvent molecules, salts, surfactants, etc.—attached to them. Since various combinations of these unwanted components can be attached to larger species, the resulting mass spectra often display a complex mixture of many different peaks. Accordingly, it is frequently desirable to eliminate these unwanted extra species prior to introduction of ions into a mass analyzer, by subjecting the ions to fragmentation conditions that dislodge and ultimately remove the extra species while leaving the ions of the analyte otherwise intact. One of the simplest ways in which this is accomplished is known as so-called "in-source dissociation", occasionally referred to as "in-source Collision-Induced Dissociation" or "in-source CID", in which a voltage drop between two ion optical elements accelerates the ions into or through an inert gas. Upon energetically colliding with the neutral gas molecules, a portion of the ions' kinetic energy, as generated by the acceleration, is taken up by energetically excited vibrational modes that ultimately dislodge the unwanted adducted and loosely bound species. Although almost all in-source CID is presently performed downstream from an ion source, the legacy term "in-source" remains from prior times when all such fragmentation actually occurred within ion sources.

The increased velocity derived from the acceleration is ideal from the perspective of dislodging unwanted species, but may be undesirable from the perspective of transmitting ions through the remainder of the ion path of the mass spectrometer. Ideally, ions will be naturally decelerated after the initial acceleration. For example, many types of analytes (e.g. small molecules, peptides, and perhaps small proteins) may be sufficiently decelerated by collisions within the length of the conventional ion optical components prior to entering a subsequent vacuum stage. However, heavy ions may not experience a sufficient number of collisions to adequately reduce their velocity within the same path length, thereby allowing these to retain a portion of the additional kinetic energy and momentum that was imparted to them during their excursion through the voltage drop. In such instances, additional deceleration is needed.

Several approaches have been utilized to address the issue of ion deceleration in the past. For example, the gas pressure in the region downstream from the voltage drop can be increased, such that ions undergo more collisions and are therefore slowed more. Similarly, the length of the region following the voltage drop can be increased in order to provide more collisions with gas molecules. These approaches are not ideal because they will dramatically slow the transmission of smaller and lighter ions, possibly to the point that these smaller ions will require axial fields to keep them moving through the increased number of collisions. Another approach comprises trapping the ions within an ion optical component disposed immediately downstream from the region of the voltage drop, thereby causing the ions to pass back and forth though the component numerous times, such that they slow down from the increased collision path length. Packets of cooled ions are then pulsed out toward the downstream ion guiding components. This discontinuous operation is not ideal because it interrupts the Automatic Gain Control (AGC) process which is intended to measure a continuous ion flux and determine changes in the ion flux over time. Accordingly, new techniques to compensate for the increased kinetic energy of heavy ions incurred from the use of in-source dissociation will be advantageous in various experimental situations.

SUMMARY

Offset electrical potentials applied to the ion optics near the ion inlet end of a mass spectrometer are dynamically adjusted in order to compensate for the increased kinetic energy of heavy ions incurred from the use of "in-source dissociation". This allows for the efficient removal of solvent, salt, surfactants, etc. from the heavy ions of interest without compromising transmission through the rest of the instrument. A first mass spectrometry method in accordance with the present teachings comprises: generating ions including analyte ions using an ion source; directing the ions into and through an ion guide or ion lens within a first chamber maintained at a first vacuum pressure, the ion guide or ion lens maintained at a first offset electrical potential; transferring the ions into and through an ion guide within a second chamber maintained at a second vacuum pressure that is less than the first vacuum pressure, the ion guide within the second chamber maintained at a second offset electrical potential, wherein a difference between the first and second offset electrical potentials imparts kinetic energy to the ions that causes the ions to fragment by collision-induced dissociation within the second chamber so as to dislodge and remove adduct species from the analyte ions; and transferring the analyte ions into an ion guide within a third chamber maintained at a third vacuum pressure that is less than the second vacuum pressure, the ion guide within the third chamber maintained at a third offset electrical potential, wherein a difference between the third and second offset electrical potentials reduces a portion of the imparted kinetic energy of analyte ions passing into the third chamber from the second chamber.

According to some embodiments, the analyte ions are transferred from the third chamber to a mass analyzer of a mass spectrometer. According to some other embodiments, the analyte ions are transferred from the third chamber to a collision cell or reaction cell of a mass spectrometer, within which product ions are generated from the analyte ions; and the product ions are transferred from the collision cell or reaction cell to a mass analyzer. According to some embodiments, the analyte ions are transferred from the third chamber to a mass filter of the mass spectrometer, wherein the mass filter only transmits ions comprising restricted range of mass-to-charge ratios (m/z) completely therethrough. The ions comprising the restricted m/z range may then be transferred to a collision cell or reaction cell of a mass spectrometer, or the ions may be transmitted to a mass analyzer.

In various embodiments, the transfer of the analyte ions into the ion guide within the third chamber causes the ions to pass through an ion lens disposed between the second and third chambers, the lens maintained at a fourth offset electrical potential, wherein a difference between the fourth and second offset electrical potentials causes ions within the ion guide within the second chamber to migrate towards the ion lens. In various embodiments, the analyte ions comprise a known value of m/z and the values of the first, second and third offset electrical potentials are determined from a prior mass spectrometer calibration of optimal offset electrical potential settings against m/z. According to some embodiments in which the analyte ions are transferred from the third chamber to a mass analyzer, the analyte ions comprise a plurality of ion species comprising respective m/z values and the values of the first, second and third offset electrical potentials are caused to vary in coordination with either sequential mass analysis or sequential mass filtering of the analytes in sequence in the order (or reverse order) of their m/z values. According to some embodiments in which the analyte ions are transferred from the third chamber to a collision cell, the analyte ions comprise a plurality of ion species comprising respective m/z values and the values of the first, second and third offset electrical potentials are caused to vary in coordination with sequential fragmentation of the analyte ions in the order (or reverse order) of the m/z values of the analyte ions.

A mass spectrometer system in accordance with the present teachings comprises: an ion source; first, second and third chambers; a vacuum system configured to maintain the first, second and third chambers at a first, a second, and a third vacuum pressure, respectively, wherein the first vacuum pressure is greater than the second vacuum pressure and the second vacuum pressure is greater than the third vacuum pressure; an ion guide or ion lens disposed within the first chamber, an ion guide disposed within the second chamber and another ion guide disposed within the third chamber, respectively; at least one voltage supply configured to supply first, second and third offset electrical potentials to the ion guide or lens within the first chamber, ion guide within the second chamber and ion guide within the third chamber, respectively; a mass analyzer; and a controller configured to control the values of the supplied first, second and third offset electrical potentials such that a difference between the first and second offset electrical potentials imparts kinetic energy to the ions that causes ions to fragment by collision-induced dissociation within the second chamber so as to dislodge and remove adduct species from analyte ions and such that a difference between the third and second offset electrical potentials reduces a portion of the imparted kinetic energy of analyte ions passing into the third chamber from the second chamber.

According to various embodiments, the controller is configured to, when the analyte ions comprise a known m/z value, cause the at least one voltage supply to set the values of the first, second and third offset electrical potentials in accordance with a prior mass spectrometer calibration of optimal offset electrical potential settings against m/z. According to various embodiments, the controller is configured to perform the steps of: controlling the mass analyzer to generate a set of test mass spectra of a sample, wherein one or more of the first, second and third offset electrical potentials are varied between consecutive test mass spectra; provide the test mass spectra to a user for evaluation; receive an indication from the user of an optimal test spectrum; and generate a mass spectrum of a sample of an unknown composition using settings of the first, second and third offset electrical potentials corresponding to the user-indicated optimal test spectrum. According to various other embodiments, the controller is configured to perform the steps of: controlling the mass analyzer to generate a set of test mass spectra of a sample, wherein one or more of the first, second and third offset electrical potentials are varied between consecutive test mass spectra; automatically determine an optimal test spectrum from among the set of test spectra; and generate a mass spectrum of a sample of an unknown composition using settings of the first, second and third offset electrical potentials corresponding to the optimal test spectrum.

The mass spectrometer system may further comprise an ion lens disposed between the second and third chambers. The controller may be configured to supply a fourth offset electrical potential to the lens such that a difference between the fourth and second offset electrical potentials causes ions within the ion guide within the second chamber to migrate towards the ion lens. The controller may be configured, when the analyte ions are positively charged, to cause the at least one voltage supply to cause the supplied third offset electrical potential to be less than the supplied first offset electrical potential, and the supplied second offset electrical potential to be less than the supplied third offset electrical potential. The controller may be further configured, when the analyte ions are negatively charged, to cause the at least one voltage supply to cause the supplied third offset electrical potential to be greater than the supplied first offset electrical potential, and the supplied second offset electrical potential to be greater than the supplied third offset electrical potential.

In accordance with some embodiments, if the analyte ions comprise a plurality of ion species comprising respective m/z values, then the controller may be configured to control the at least one voltage supply such that a plurality of batches of ions are separately transmitted from the third chamber to an ion storage apparatus within which the plurality of batches of ions are accumulated together, wherein values of the first, second and third offset electrical potentials are caused to vary between each successive pair of batch transmissions. According to such embodiments, the so-accumulated ions of the plurality of batches are subsequently transmitted, after the accumulation, to a mass analyzer for mass analysis. By this process, it is assured that analyte ions of all m/z values of interest are able to pass from the second chamber to the third chamber and, further, that the mass spectrum portion corresponding to each batch of the ion species is cleared of interferences from adducted and other loosely bound species.

In accordance with some other embodiments, the controller may be configured to, if the analyte ions comprise a plurality of ion species comprising respective m/z values, control the at least one voltage supply such that the values of the first, second and third offset electrical potentials are caused to vary in coordination with a sequential injection. In some embodiments these sequential injections are coordinated with scanning operation of the mass analyzer wherein analytes are transmitted from the mass analyzer to a detector in sequence in the order (or reverse order) of their m/z values. The mass spectrometer system may further comprise: a mass filter disposed between the ion guide within the third chamber and the mass analyzer; and a collision cell disposed between the mass filter and the mass analyzer. In such instances, the controller may be further configured to, if the analyte ions comprise a plurality of ion species comprising respective m/z values, control the at least one voltage supply such that the values of the first, second and third offset electrical potentials are caused to vary in coordination with a sequential scanning operation of the mass filter wherein analytes are transmitted from the mass filter to the collision cell in sequence in the order of their m/z values and product ions generated in the collision cell are transmitted to the mass analyzer.

BRIEF DESCRIPTION OF THE DRAWINGS

The above noted and various other aspects of the present invention will become apparent from the following description which is given by way of example only and with reference to the accompanying drawings, not necessarily drawn to scale, in which.

DETAILED DESCRIPTION

Figure 1A:
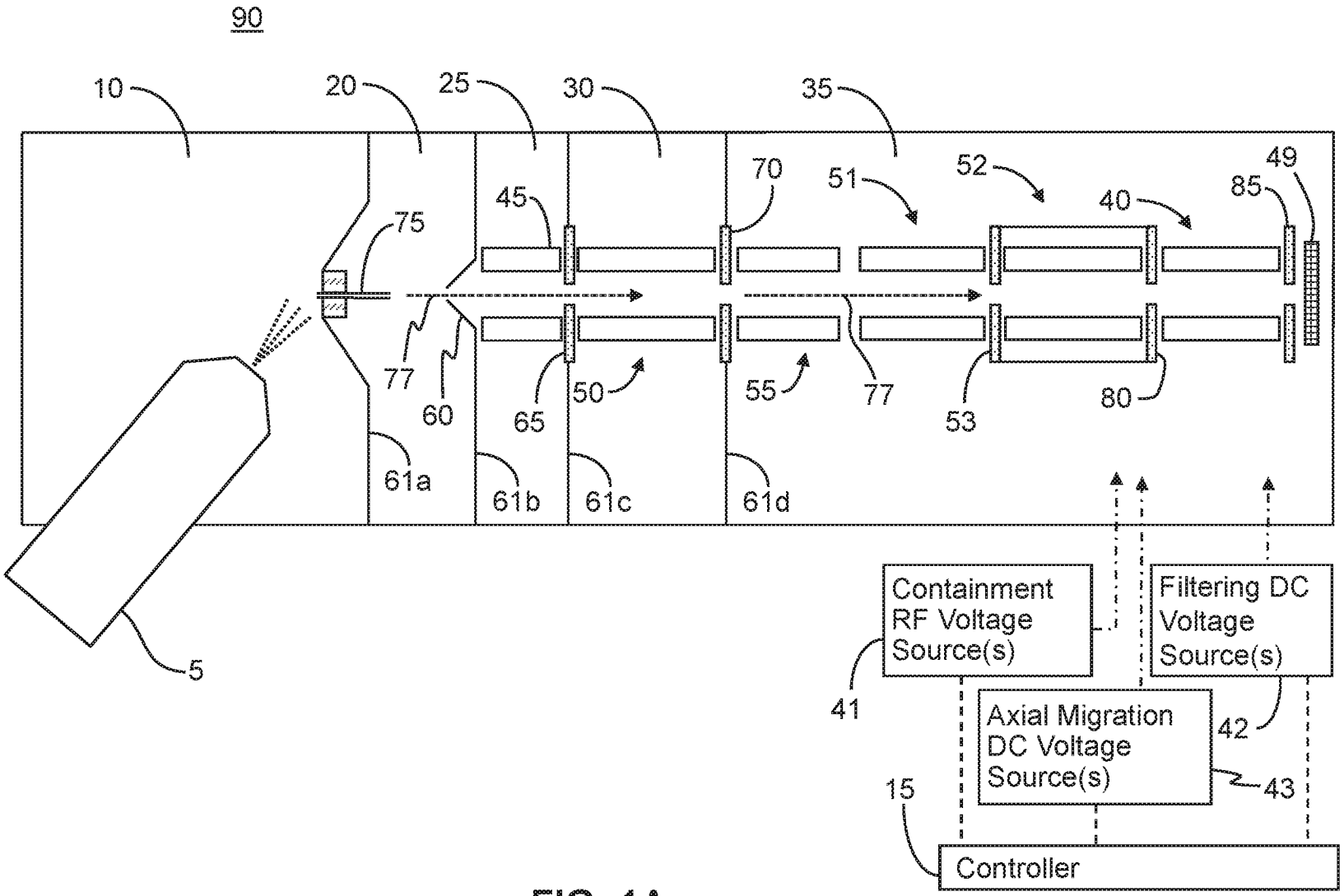
FIG. 1A (Prior Art)
FIG. 1A is a schematic diagram showing components of a conventional mass spectrometer system.

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. To fully appreciate the features of the present invention in greater detail, please refer to FIGS. 1A, 1B, 2, 3, 4A and 4B in conjunction with the following description.

In this description, it is understood that a word appearing in the singular encompasses its plural counterpart, and a word appearing in the plural encompasses its singular counterpart, unless implicitly or explicitly understood or stated otherwise. Furthermore, it is understood that, for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the presentation. Also, reference numerals may be repeated among the various figures to show corresponding or analogous elements. Additionally, it will be understood that any list of such candidates or alternatives is merely illustrative, not limiting, unless implicitly or explicitly understood or stated otherwise.

In this description, the terms "ion optic", "ion optics", "ion optical component", and/or "ion optical element" are used to denote any electrode-bearing component(s) that is(are) used for guiding, pulling, focusing, shaping, lensing, expanding, gating, switching or diverting a stream of ions. Such terms do not necessarily imply any light-manipulation properties of any component. As used herein, the term "DC" (for "Direct Current") is used only for the purpose of designating a non-oscillatory voltage or non-oscillatory electrical potential applied to an electrode and does not necessarily imply the existence of a current that is carried by the movement of electrons through wires, electrodes or other conductors. As used herein, the term "offset electrical potential" is used to denote such a "DC" potential that, in operation of a mass spectrometer, is applied to an ion guiding, ion lensing, ion trapping, or other ion optical component along a general ion pathway within a mass spectrometer apparatus or system for purposes of controlling ion motion along the ion pathway. Differences between such offset electrical potentials that are applied to different respective ion optical components are used to move ions between such components along a general ion pathway as well as to arrest the motion of ions, to trap ions along a segment of an ion pathway or to switch a flow of ions from one pathway to another. Offset electrical potentials are generally static during any particular mode of ion flow but may be occasionally switched to different voltage values when the mode of flow, rate of flow, direction of flow, etc. is to be changed. The offset electrical DC potential is to be distinguished from "scanning DC" that is may or may not be static and that is primarily employed for controlling the stability (or lack thereof) of ion motion within an ion trap for the purpose of filtering or otherwise separating ions in accordance with their mass-to-charge ratio (m/z) values. It should also be noted that applied DC potentials or voltages are frequently superimposed on oscillatory voltage waveforms. In some instances, superimposed oscillatory, scanning DC and offset electrical potential voltages may all be applied simultaneously to a single electrode.

Unless otherwise defined, all other technical and scientific terms used herein have the meaning commonly understood by one of ordinary skill in the art to which this invention belongs. In case of conflict, the present specification, including definitions, will control. It will be appreciated that there is an implied "about" prior to the quantitative terms mentioned in the present description, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. As used herein, "a" or "an" also may refer to "at least one" or "one or more." Also, the use of "or" is inclusive, such that the phrase "A or B" is true when "A" is true, "B" is true, or both "A" and "B" are true.

FIG. 1A depicts the components of an exemplary conventional mass spectrometer system 90 that may be employed for tandem mass spectrometry. It will be understood that certain features and configurations of the mass spectrometer system 90 are presented by way of illustrative examples, and should not be construed as limiting the implementation of the present teachings in or to a specific environment. An ion source, which may take the form of an electrospray ion source 5, generates ions from an analyte material supplied from a sample inlet. For example, the sample inlet may be an outlet end of a chromatographic column, such as liquid or gas chromatograph (not depicted), from which an eluate is supplied to the ion source. The ions are transported from ion source chamber 10 that, for an electrospray source, will typically be maintained at or near atmospheric pressure, through several intermediate chambers 20, 25 and 30 of successively lower vacuum pressures, to a high vacuum chamber 35. The ions follow a generally straight ion pathway 77 through the mass spectrometer system 90 as indicated by the arrows. However, it is often the case that the pathway 77 through a mass spectrometer system is not truly straight along its entire length, as one or more ion guiding components may utilize slight bends in order to aid in the separation of ions from neutral molecules. A series of partitions, such as partitions 61*a*, 61*b*, 61*c*, and 61*d* separate the various chambers, one from another, in order to facilitate differential vacuum pumping by one or more vacuum pumps (not shown). The high vacuum chamber 35 (i.e., the chamber having the lowest vacuum pressure) may house a quadrupole mass filter (QMF) 51, an ion reaction cell 52 (such as a collision or fragmentation cell) and a mass analyzer 40. Efficient transport of ions from ion source 5 to the vacuum chamber 35 within the mass spectrometer system 90 is facilitated by a number of ion optic components, including multipole radio-frequency (RF) ion guides 45, 50 and 55, skimmer 60, and electrostatic lenses 65 and 70. Ions may be transported between the ion source chamber 10 and the first intermediate chamber 20 through an ion transfer tube 75 that may be heated to evaporate residual solvent and break up solvent-analyte clusters.

Electrodes 80 and 85 (which may take the form of conventional plate lenses) positioned axially outward from the mass analyzer 40 may be used in the generation of a potential well for axial confinement of ions, and also to effect controlled gating of ions into the interior volume of the mass analyzer 40. The mass analyzer 40, which may comprise a quadrupole ion trap, a quadrupole mass filter, a time-of-flight analyzer, a magnetic sector mass analyzer, an electrostatic trap, or any other form of mass analyzer, is provided with at least one detector 49 that generates a signal representative of the abundance of ions that exit the mass analyzer. If the mass analyzer 40 is provided as a quadrupole mass filter, then a detector at detector position as shown in FIG. 1A will generally be employed so as to receive and detect those ions which selectively completely pass through the mass analyzer 40 from an entrance end to an exit end. If, alternatively, the mass analyzer 40 is provided as a linear ion trap or other form of mass analyzer, then one or more detectors at alternative detector positions may be employed.

Ions enter an inlet end of the mass analyzer 40 as a continuous or quasi-continuous beam after first passing, in the illustrated conventional apparatus, through a quadrupole mass filter (QMF) 51 and an ion reaction cell 52. The QMF 51 may take the form of a conventional multipole structure operable to selectively transmit ions within an m/z range determined by the applied RF and DC voltages. The reaction cell 52 may also be constructed as a conventional multipole structure to which an RF voltage is applied to provide radial confinement. The reaction cell is provided so as to manipulate ions in a fashion that generates new so-called product ions from the incoming ions. For instance, a reaction cell may be configured so as to be able to receive, in addition to the incoming sample-derived ions, an ionized chemical reagent that reacts with certain sample-derived ion species so as to generate new product-ion species. Alternatively, the reaction cell may be configured, in conventional fashion, as a collision cell for fragmenting the sample-derived ions by the method of collision-induced dissociation, the fragment-ion species that result from the dissociation comprising the new product-ion species. In such operation, the interior of the cell 52 is pressurized with a suitable collision gas, and the kinetic energies of ions entering the collision cell 52 may be regulated by adjusting DC offset voltages applied to QMF 51, collision cell 52 and lens 53.

The operation of the various components of the mass spectrometer systems may be directed by a controller or a control and data system 15, which will typically consist of a combination of general-purpose and specialized processors, application-specific circuitry, and software and firmware instructions and which may include a general purpose computer. The control and data system 15 may also provide data acquisition and post-acquisition data processing services. Typically, control of the mass spectrometer system includes controlled provision of various radio-frequency (RF) and/or non-radio-frequency (AC) oscillatory voltages as well as non-oscillatory voltages (so-called "DC" voltages) to the various ion lenses, ion gates, multipoles and other ion guides of the mass spectrometer system. These voltages are provided by one or more voltage sources, such as voltage sources 41, 42 and 43, of which the voltage output is controlled by the controller 15.

Figure 1B:
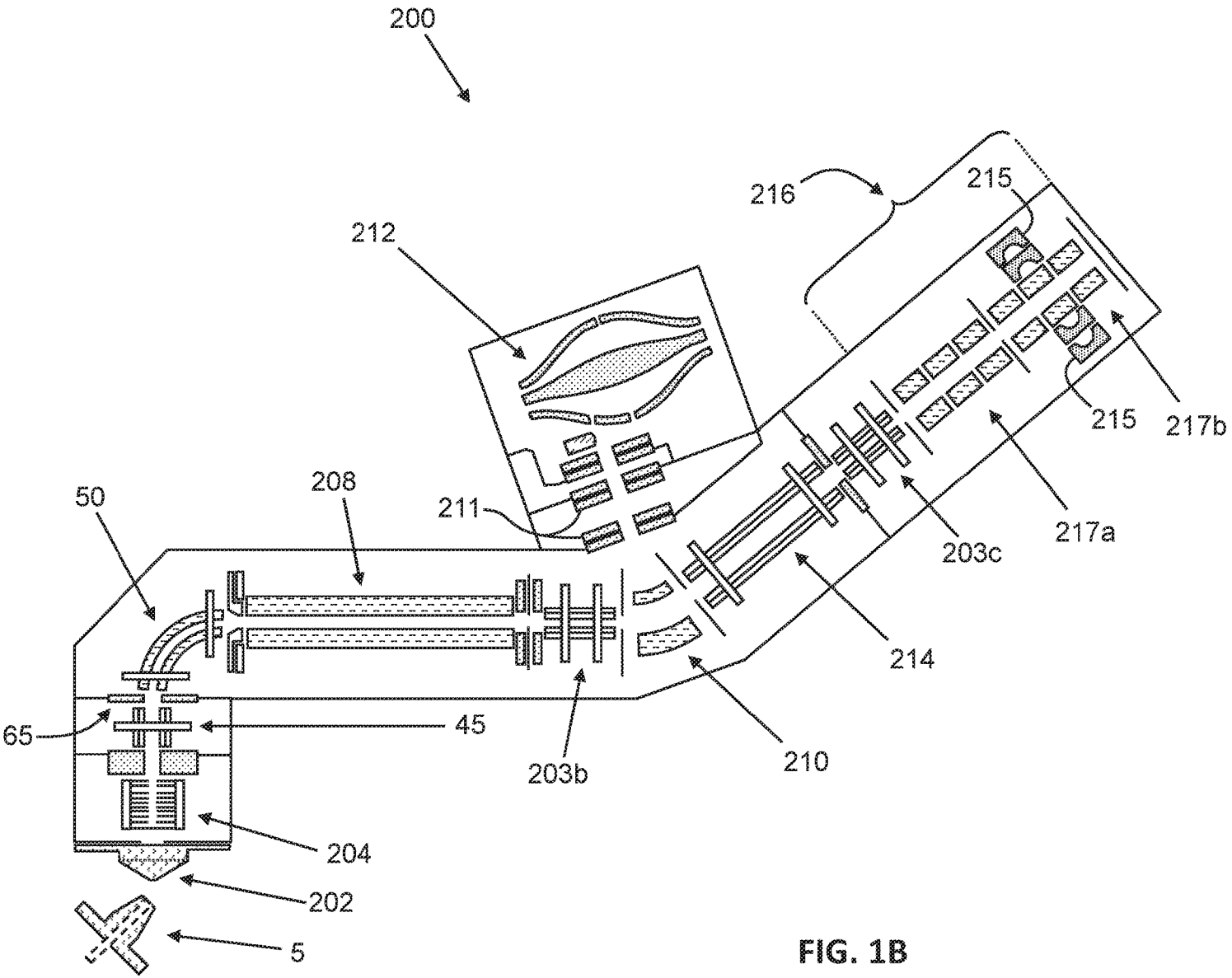
FIG. 1B is a schematic representation of an exemplary hybrid mass spectrometer system, the hybrid system comprising a quadrupole mass filter, a dual-pressure quadrupole ion trap mass analyzer and an electrostatic trap mass analyzer.

FIG. 1B is a more-detailed schematic depiction of another exemplary mass spectrometer system 200. The mass spectrometer illustrated in FIG. 1B is a hybrid mass spectrometer, comprising more than one type of mass analyzer. Specifically, the mass spectrometer 200 includes an ion trap mass analyzer 216 as well as an Orbitrap™ analyzer 212, which is a type of electrostatic trap mass analyzer. In operation of the mass spectrometer system 200, an electrospray ion source 5 provides ions of a sample to be analyzed to an aperture 202, at which the ions enter into a first intermediate-vacuum chamber. After entry, the ions are captured and focused into a tight beam by a stacked-ring ion guide 204 or by an ion funnel at the same position. A first multipole ion guide 45 transfers the beam into downstream chambers of the mass spectrometer, where, as noted above, the various chambers are differentially pumped such that each succeeding chamber is maintained at a lower pressure than the preceding chamber. In contrast to the mass spectrometer system 90 (FIG. 1A), the second multipole ion guide 50 is curved so as to cause neutral molecules to be separated from the main ion beam. Specifically, the neutral molecules follow a straight-line path whereas the ions of interest are caused to bend around a ninety-degree turn by a drag field applied to the ion guide 50, thereby producing the separation.

A quadrupole mass filter 208 of the mass spectrometer 200 is used in its conventional sense as a tunable mass filter so as to pass ions only within a selected narrow mass-to-charge (m/z) range. A subsequent ion guide 203*b* delivers the filtered ions to a curved quadrupole ion trap ("C-trap") component 210. The C-trap 210 is able to transfer ions along a pathway between the quadrupole mass filter 208 and the ion trap mass analyzer 216. The C-trap 210 also has the capability to temporarily collect and store a population of ions and then deliver the ions, as a pulse or packet, into the Orbitrap™ mass analyzer 212. The transfer of packets of ions is controlled by the application of electrical potential differences between the C-trap 210 and a set of injection electrodes 211 disposed between the C-trap 210 and the Orbitrap™ mass analyzer 212. The curvature of the C-trap is designed such that the population of ions is spatially focused so as to match the angular acceptance of an entrance aperture of the Orbitrap™ mass analyzer 212.

Multipole ion guide 214 and optical transfer component 203*b* serve to guide ions between the C-trap 210 and the ion trap mass analyzer 216. The multipole ion guide 214 provides temporary ion storage and can also serve as a fragmentation cell. Various gate electrodes along the pathway between the C-trap 210 and the ion trap mass analyzer 216 are controllable such that ions may be transferred in either direction, depending upon the sequence of ion processing steps required in any particular analysis method.

The ion trap mass analyzer 216 is a dual-pressure linear ion trap (i.e., a two-dimensional trap) comprising a high-pressure linear trap cell 217*a* and a low-pressure linear trap cell 217*b*, the two cells being positioned adjacent to one another separated by a plate lens having a small aperture that permits ion transfer between the two cells and that presents a pumping restriction and allows different pressures to be maintained in the two traps. The environment of the high-pressure cell 217*a* favors ion cooling, but also favors ion fragmentation under controlled conditions by either collision-induced dissociation or electron transfer dissociation or ion-ion reactions such as proton-transfer reactions. The environment of the low-pressure cell 217*b* favors analytical scanning with high resolving power and mass accuracy. The low-pressure cell includes a dual-dynode ion detector 215.

Figure 2A:
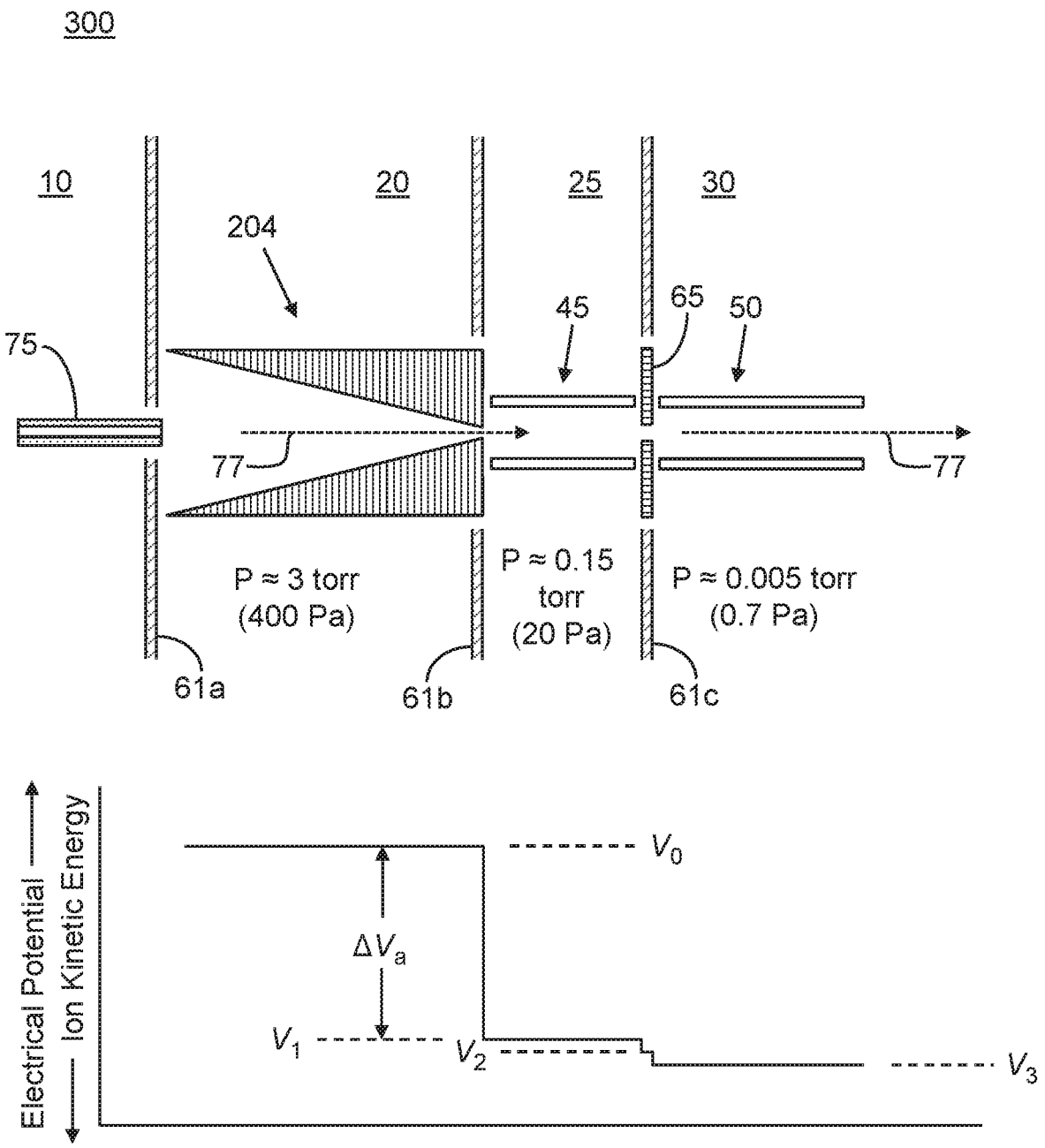
FIG. 2A is a schematic representation of a portion of an exemplary mass spectrometer system and of a profile of electrical potentials applied to components of the portion of the mass spectrometer system according to a conventional mode of operation.

FIG. 2A shows, in its top section, a schematic depiction of a portion 300 of a mass spectrometer system, the portion 300 including a portion of an ionization chamber 10 and at least a portion of each of the first three intermediate-vacuum chambers 20, 25, 30 as well as an ion transfer tube 75 and the partitions 61*a*, 61*b*, 61*c* separating the chambers, one from another. The top section of FIG. 2A is also reproduced in FIG. 3. The mass spectrometer portion 300 of FIGS. 2A and 3 combines features from both of FIGS. 1A and 1B. For example, the ion funnel 204 is present in the mass spectrometer system 200 (FIG. 1B) and in the mass spectrometer portion 300 (FIGS. 2A and 3) but not in the mass spectrometer system 90 (FIG. 1A). Although the ion guide 50 is illustrated as being generally straight in the system 90 (FIG. 1A) and in the system portions 300 and 301 (FIGS. 2A, 2B and 3), it is curved in the system 200 (FIG. 1B). Finally, from inspection, it is clear that the hybrid mass spectrometer system 200 comprises various components that are not present in the more simple system 90.

Figure 2B:
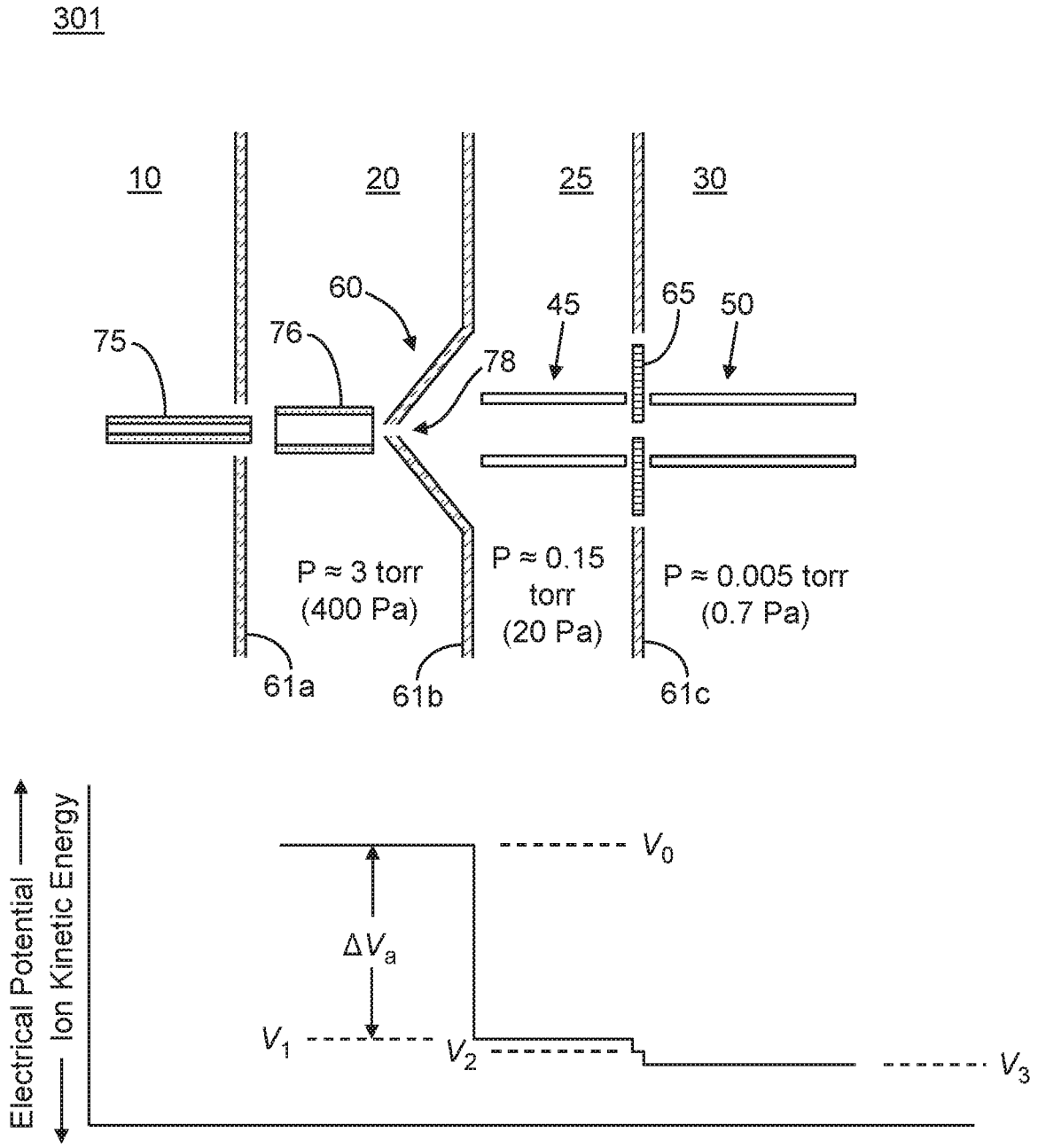
FIG. 2B is a schematic representation of a portion of another exemplary mass spectrometer system and having a same general conventional profile of applied electrical potentials as depicted in FIG. 2A.
Figure 3:
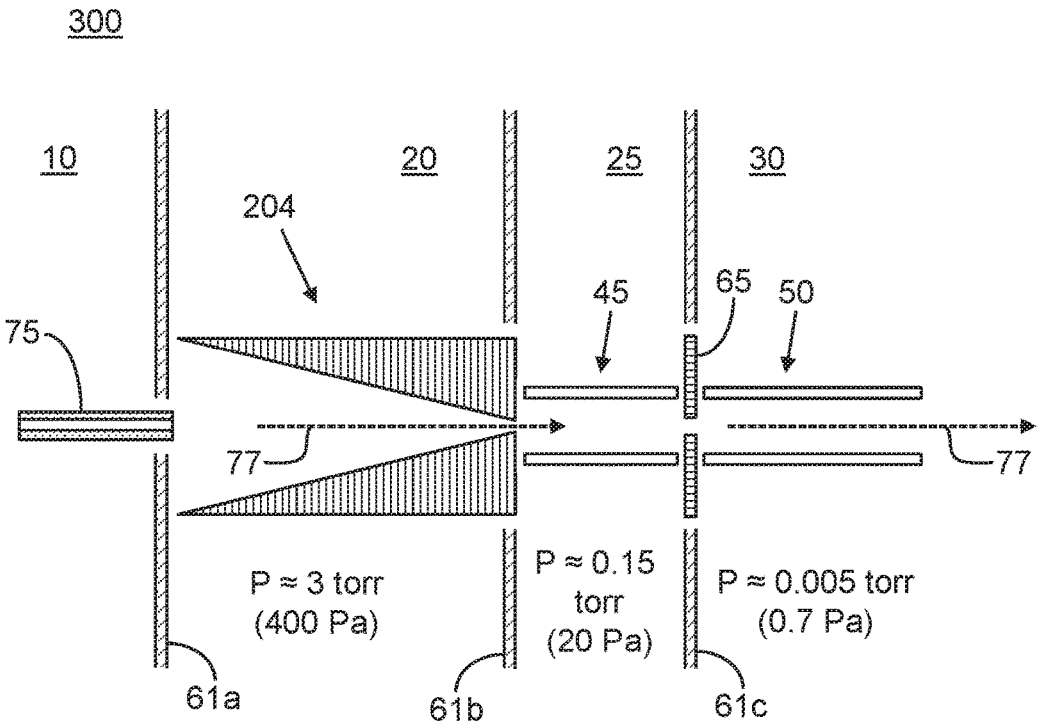
FIG. 3 is a schematic representation of the portion of the exemplary mass spectrometer system of FIG. 2A and of a profile of electrical potentials applied to components of the portion of the mass spectrometer system in accordance with the present teachings.
Figure 3:
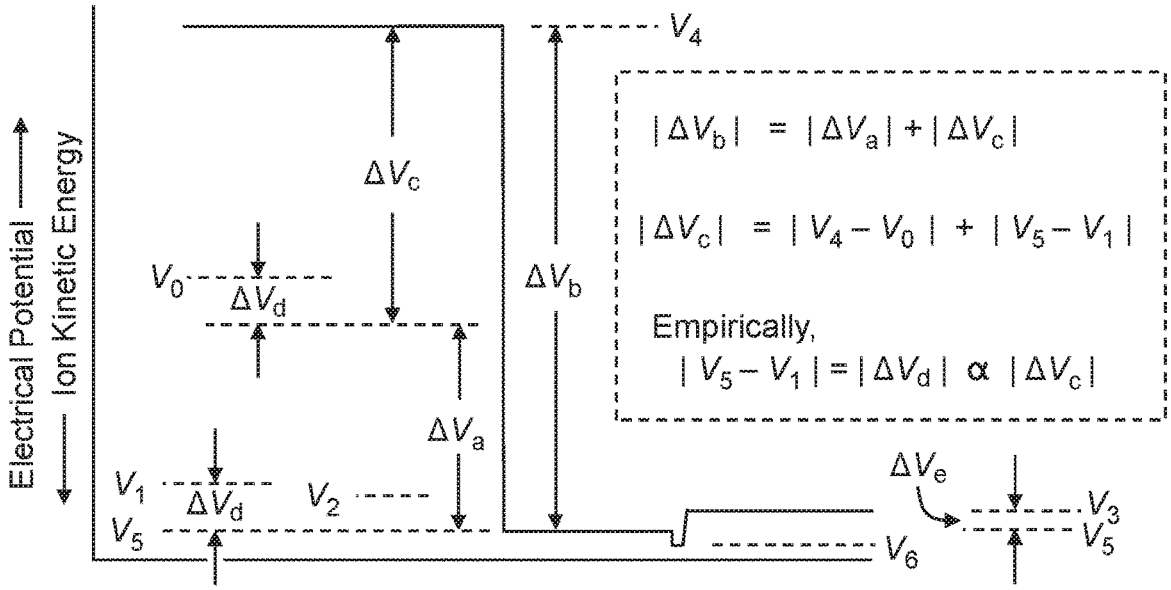

The mass spectrometer system portion 301 depicted in FIG. 2B is similar to the system portion 300 of FIG. 2A except that the ion funnel 204 is replaced by a tube lens 76 and a skimmer 60. Like the ion funnel, the tube lens 76 confines the motion of ions to the vicinity of a longitudinal axis of the lens as they pass through the chamber 20 towards an aperture 78 of the skimmer 60. In known fashion, the skimmer 60 separates ions from neutral gas molecules. Ions are caused to pass through the aperture, whereas gas molecules are directed away from the aperture by the skimmer surface. The various differences and component-level substitutions between mass spectrometer systems noted above are illustrative of the fact that the ion-guiding, ion lensing and gas-channeling components illustrated in FIGS. 2A, 2B and 3 are presented as mere examples. In a general sense, stacked ring ion guides, ion funnels and the various multipoles (quadrupoles, octopoles, etc.) are all examples of a general class of components that may be termed "ion guides" and, often, one type of ion guide may be replaced by a different type of ion guide. Further, one or more ion lenses (such as the tube lens 76 shown in FIG. 2B) may be substituted for an ion guide. The ion transfer tube 75 is an example of a general class of components that may be termed "ion and gas channels". Accordingly, a simple aperture is another example of this class of components which may be employed as a substitute for an ion transfer tube. In the following discussion relating to FIGS. 2A, 2B and 3, it should be noted that it is possible to substitute for the various illustrated ion guide components and for the ion transfer tube, as discussed above, without affecting the applicability of the present teachings.

The bottom section of FIG. 2A provides a schematic profile of electrical potentials applied to components of the portion of the mass spectrometer system 300 according to a conventional mode of operation during the analysis of positively-charged ions. This same profile is also reproduced in FIG. 2B. It should be noted that the principles of the present teachings are also applicable to the analysis of negatively-charged ions, provided that the illustrated potential profiles are replaced by their respective mirror images, as mirrored about a horizontal line. It is to be understood that the illustrated potentials are static (DC) potentials that may be superimposed upon any oscillatory confining potentials (not illustrated) applied to the illustrated components. The stepped progressively decreasing series of electrical potentials depicted in FIGS. 2A-2B is conventionally employed to maintain a continuous flow of positive ions from the first intermediate-vacuum chamber 20 to the second intermediate-vacuum chamber 25, through the second intermediate-vacuum chamber 25 to lens 65 and from lens 65 into the third intermediate vacuum chamber 30. The potential $V_0$ is the potential applied to the ion guide (in the illustrated example, ion funnel 204) within the first intermediate-vacuum chamber 20 and the potential $V_1$ is the potential applied to the ion guide (in the illustrated example, first multipole 45) within the second intermediate-vacuum chamber 25. The difference, $\Delta V_a$, between these two applied electrical potentials is typically maintained at a value in the approximate range of 10-20 volts in order to provide sufficient energy for the ions to pass through the intermediate pressure region in vacuum chamber 25 while, at the same time, not imparting sufficient kinetic energy to the ions to cause their fragmentation upon colliding with gas molecules. The potential $V_2$ is the potential applied to the lens 65 and the potential $V_3$ is the potential applied to the ion guide (in the illustrated example, second multipole 50) within the third intermediate-vacuum chamber 30. The potential drop between $V_2$ and $V_2$ is typically much less—generally <3 volts.

The bottom section of FIG. 3 is a schematic profile of electrical potentials applied to components of the portion of the mass spectrometer system during analysis of positively charged ions in accordance with the present teachings. For comparison with FIGS. 2A-2B, the values of the potentials $V_0$, $V_1$, $V_2$ and $V_3$, as previously defined with reference to FIG. 2, are reproduced in FIG. 3. Preferably, the DC potential applied to the multipole 50 in vacuum chamber 30 remains unchanged from its value, $V_3$, employed during conventional operation in order to maintain appropriate DC potential differences between the multipole 50 and downstream mass spectrometer ion optics components. However, other potentials are changed relative to those shown in FIG. 2. In particular, the absolute magnitude of the potential difference, $|\Delta V_b|$, between the DC potentials applied to multipole 45 and the ion funnel 204 is increased, by an amount $\Delta V_c$, relative to the absolute magnitude of the corresponding potential difference, $|\Delta V_a|$, that is employed during conventional operation. The quantity $\Delta V_c$ is here termed the "in-source fragmentation energy". Specifically, $$|\Delta V_b| = |\Delta V_a| + |\Delta V_c| \quad (1)$$

as is indicated in the bottom section of FIG. 3.

The increased magnitude of $\Delta V_b$ relative to $\Delta V_a$ is chosen such that sufficient kinetic energy is imparted to ions passing through the multipole 45 to cause dislodgement of loosely bound and adducted species from analyte ions upon collision of the ions with gas molecules in the second intermediate chamber 25. However, the magnitude of $\Delta V_b$ is insufficient to disrupt the structure of the analyte ions themselves by fragmentation. The dislodged species are either undetectable by mass spectrometry (e.g., neutral molecules), ejected from the ion beam path (e.g., removed by the quadrupole mass filter), or else otherwise outside of the m/z range of interest. Although most of the discussion in this document is directed to the use of in-source ion fragmentation for dislodging adducted and other loosely bound species which are generally attached to analyte ions by relatively weak non-covalent bonds, it is worth noting that it is possible, by using the same methods discussed herein, to impart sufficient energy to analyte ions to break the stronger chemical and covalent bonds that define their polyatomic structures. Such analyte fragmentation methods need not be limited to just in-source fragmentation could be employed at other locations within a mass spectrometer system.

The effect of loosely bound and adducted species on mass spectral results is particularly problematical for the analysis of ions of polymeric organic molecules; such as nucleic acids, polypeptides, proteins and carbohydrates; that are ionized by electrospray or thermospray ionization. Because such large organic polymeric molecules are generally multiply charged and have surface areas that are large, relative to the sizes of potential loosely bound and adducted species, there are a relatively large number of molecular "sites" at which the loosely bound and adducted species may attach themselves. Such species are derived from solvent materials and dissolved contaminants and may include neutral molecules such as $H_2O$ and/or $NH_3$ as well as small cations and anions derived from dissolved salts, detergents, etc.

Figure 4A:
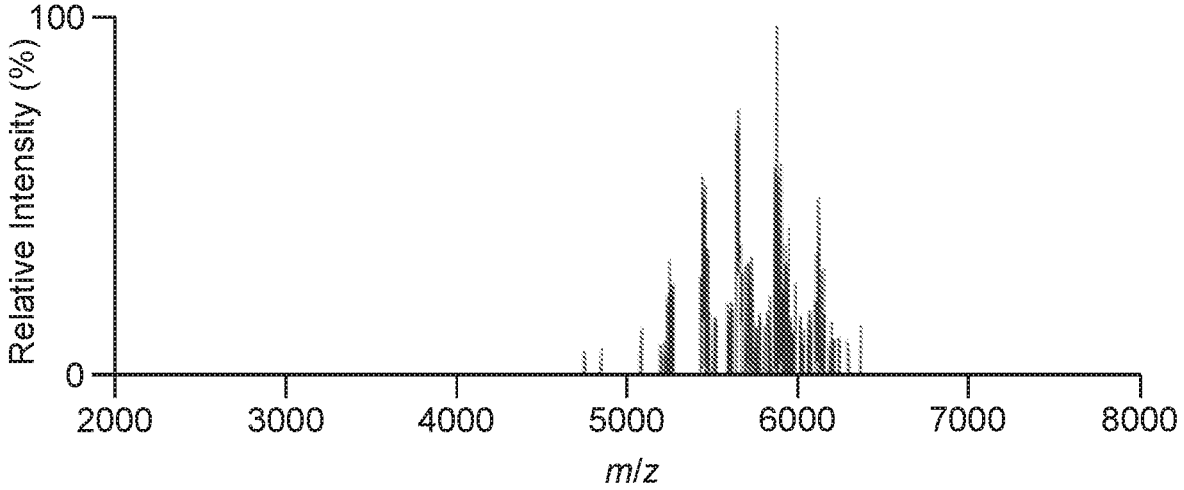
FIG. 4A is a mass spectrum of a standard sample of the monoclonal antibody trastuzumab as obtained by a mass spectrometer operated in accordance with a conventional mode of operation.
Figure 4B:
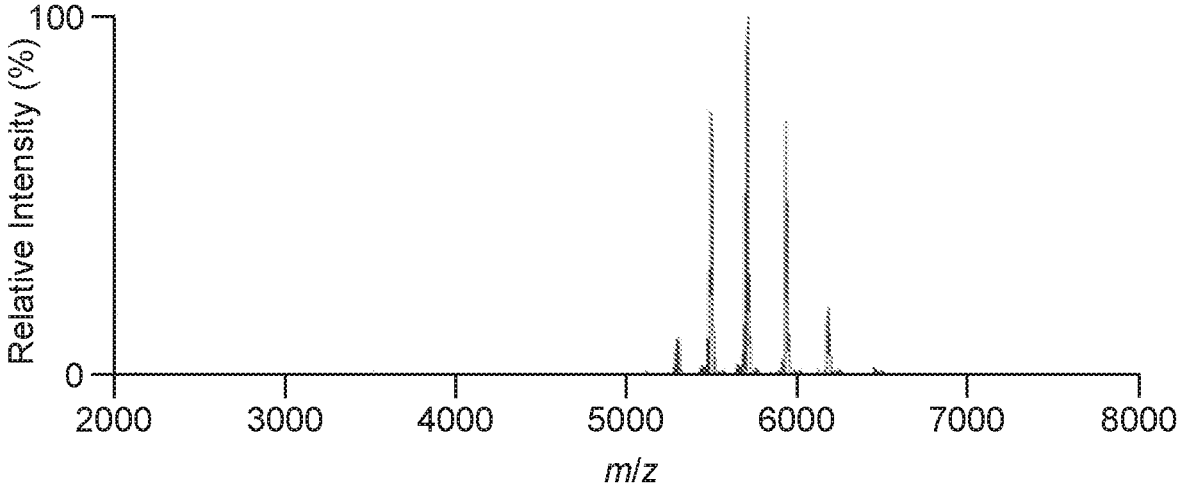
FIG. 4B is a mass spectrum of the standard sample of trastuzumab as obtained by a mass spectrometer operated in accordance with the present teachings.

FIGS. 4A and 4B illustrate the effects of loosely bound and adducted species on the mass spectrum of a large organic molecule—in the present example, a standard sample of the monoclonal antibody trastuzumab. FIG. 4A is a mass spectrum of the sample obtained using electrospray ionization and conventional operation (i.e., operation using a voltage profile as in FIG. 2) of a mass spectrometer system similar to that illustrated in FIG. 1B. Although the basic outline of the protein spectrum is observed, the diagnostic details are obscured by splitting many or all of the protein lines by the attachment of extra species. In contrast, FIG. 4B is a mass spectrum of the same sample obtained using the same apparatus operated in accordance with the present teachings. The mass spectrum of FIG. 4B is sufficiently improved to reveal distinct lines associated with the various protein charge states as well as natural isotopic splitting of those lines.

Returning now to the discussion of FIG. 3, it may be observed that, although the value of potential $V_3$ remains unchanged relative to that employed in conventional operation (c.f., the lower section of FIG. 2), the values of all other applied potentials are changed relative to those employed during conventional operation. The increased magnitude of the potential difference, from $|\Delta V_a|$ under conventional operation to $|\Delta V_b|$ in accordance with the present teachings, provides increased kinetic energy to ions that enables in-source fragmentation as described above. However, after absorption of some of the imparted energy by the in-source fragmentation, the remaining extra kinetic energy, if not otherwise moderated after the fragmentation, would generally cause an increased velocity of the ions along the general downstream ion pathway 77 through the mass spectrometer. In the case of heavy ions, such as polymeric organic molecules, there may not be sufficient gas pressure or sufficient path length within the second intermediate-vacuum chamber 25 to damp this increased velocity. The extra kinetic energy may not allow the ions of interest to negotiate various ion pathways within a mass spectrometer system. Such energetic ions would then fly out of the ion pathway and be lost from the mass spectrometer system. Such a result has been verified by experiment (results not shown).

In order to damp the extra kinetic energy and slow the ion velocity, the potential of ion guide 45 is lowered, by an amount, $\Delta V_d$, from $V_1$ to $V_5$ as indicated in FIG. 3. Thus, with the so-lowered potential of the ion guide, ions passing from chamber 25 to chamber 30 must give up a portion of their kinetic energy that corresponds to the potential difference $V_3 - V_5$ ($=\Delta V_e$). Given that the potential of the ion guide 50 is fixed at $V_3$ as well as the empirical fact that the potential difference, $\Delta V_c$, corresponding to the in-source fragmentation energy is much greater than the potential difference, $\Delta V_d$, that is related to the excess kinetic energy, the practical effect is that the electrical potential that must be applied to ion guide (e.g., ion funnel) 204 is necessarily raised relative to the fixed $V_3$ and, consequently, raised from $V_0$ to $V_4$, as shown in FIG. 3.

Given the definitions of $V_0$, $V_1$, $V_4$ and $V_5$, Eq. (1) may be re-written as $$|V_5 - V_4| = |V_1 - V_0| + |\Delta V_c| \quad (2)$$

Some further mathematical relationships are provided in FIG. 3. The quantity $|\Delta V_d|$ may be envisioned as a residual portion of the imparted energy in-source fragmentation energy, $\Delta V_c$, that remains as excess kinetic energy of "clean" analyte ions after the dislodgement of adducted and loosely bound species when the applied in-source fragmentation energy, $|\Delta V_c|$, is just sufficient to dislodge all such species. Empirically, it has been found that the ratio $|\Delta V_d|/|\Delta V_c|$ has an optimum value for each given analyte and that this optimum value varies from analyte to analyte. Accordingly, excellent in-source fragmentation results may be achieved, in many cases, if the applied electrical potentials are set such that the magnitude of $\Delta V_d$ is maintained in proportion to the magnitude of $\Delta V_c$, in other words $$|\Delta V_d| = k|\Delta V_c| \quad (3)$$

where k is an analyte-dependent proportionality constant and where $\Delta V_d = (V_5 - V_1)$ is less than zero for positively-charged ions and greater than zero for negatively-charged ions. Depending on the m/z values and types of heavy analyte ion species that are being investigated, the value of k may range from 0.05 to approximately 0.20. Convenient values of k are 0.05, 0.10, 0.15 and 0.20. Another quantity, $\Delta V_e$, may be defined (see FIG. 3) as the difference between the electrical potential applied to multipole 50 and the electrical potential applied to multipole 45. From FIG. 3, this quantity, $\Delta V_e$, corresponds, with regard to positively charged ions, to the upward step in potential that the ions must overcome in order migrate from the second chamber 25 to the third chamber 30. When the direct proportionality implied by Eq. 3 holds, then the quantity, $\Delta V_e$, is linearly related to $\Delta V_c$.

By comparing the lower section of FIG. 3 with the lower section of FIG. 2, it may be observed that, in contrast to the conventional configuration, the electrical potential, $V_6$, that is applied to the lens 65 is slightly lower (e.g., by 0.5-6 volts) than either of the potentials ($V_5$ and $V_3$) applied to components on either side of the lens, thereby creating an electrical potential well at the position of the lens. (Alternatively, if negative ions are to be analyzed, the applied potential at the lens would be a maximum in accordance with signage conventions.) This potential well is applied in order to allow low-kinetic-energy ions to exit from the ion guide 45. Because there is no axial confinement in the region between ion guide 45 and lens 65, such ions are then able to leak out from the pathway of the main ion stream. The ions that are removed in this fashion are just those ions that lack sufficient energy to overcome the potential energy barrier provided by the step "up" to potential $V_3$ from potential $V_5$ ($\approx V_6$). In general, the removed ions comprise ion species having lower m/z values than the m/z values of the analytes of interest. Such ions may be the adduct species removed by the in-source collision-induced dissociation in chamber 25 or contaminant species generated within the ion source. Otherwise, if there were no potential well at the position of the lens, such ions would remain trapped within the ion guide 45 and continued accumulation of such ions would generate a potential barrier that would disrupt the subsequent flow of all ions through the mass spectrometer.

In summary of the above discussions, $\Delta V_c$, is the magnitude of the additional potential drop, in excess of the conventional $\Delta V_a$, that must be applied, given a certain pre-set gas pressure and ion path length within the intermediate-vacuum chamber 25, in order to dislodge adducts and loosely-bound species. Further, $\Delta V_d$ is the potential difference that corresponds to the magnitude of the kinetic energy reduction that must be incurred by the heavy analyte ions, after the dislodgement, in order to reduce their kinetic energy to an appropriate level downstream from partition 61*c*, given a certain pre-set gas pressure downstream from partition 61*c*. As noted above, it is found that, under the given conditions of pre-set chamber pressures and ion path lengths, $\Delta V_d \approx k\ \Delta V_c$, where k is a dimensionless analyte-dependent proportionality factor which may be conveniently represented as a percentage such as, for example, ten percent. A specific value of k may need to be determined for each analyte.

According to a mass spectrometry method of the present teachings, in-source fragmentation, as described above, is applied to a stream of incoming ions comprising a plurality of analyte-ion species (and other ion species) comprising respective m/z values. According to the method, the fragmentation is applied as a series of several fragmentation events, wherein the values of offset electrical potentials applied to an ion guide or ion lens component in a first chamber, a second chamber and a third chamber, respectively are caused to vary between each successive pair of fragmentation events. In general, the set of offset potentials applied during each individual fragmentation event will be optimal for dislodging adduct and other loosely bound species from a different respective subset of the analyte ions. Preferably, the offset electrical potentials applied to the ion guide or ion lens components in the first, second and third chambers are such that the potential difference, $\Delta V_e$, related to a lowering of the potential applied to the component in the second chamber relative to the potential applied to the component in the third chamber, is linearly related to the potential difference, $\Delta V_c$, that corresponds to the in-source fragmentation energy. During each such event, the ions that pass into the third chamber, here termed as a "batch" of ions, are transmitted to an ion storage apparatus, such as an ion trap. According to the method, the ion storage accumulates all such batches together as a single mixed batch. The so-accumulated ions of the plurality of batches are subsequently transmitted, after the accumulation, to a mass analyzer for mass analysis. By this process, it is assured that analyte ions of all m/z values of interest are able to pass from the second chamber to the third chamber and, further, that the mass spectrum portion corresponding to each subset of the ion species is cleared of interferences from adducted and other loosely bound species.

In practice, the electrical potential "step up" to potential $V_3$ from potential $V_5$ acts as a high-pass m/z filter that eliminates ions below a certain minimum m/z value. Thus, each particular setting of k may only be appropriate for a certain range of analyte m/z values. According to a method in accordance with the present teachings, prior to obtaining a mass spectrum of a sample, a user may perform an automated method by which, through software or firmware control of a mass spectrometer instrument, the values of $\Delta V_c$ and $\Delta V_d$ are repeatedly set to various different test values and in which, at each pair of test values, a test spectrum is presented to the user for the user's evaluation. The test spectra may be obtained from a portion of the sample itself, from a prepared or standard sample of a particular analyte that the user wishes to investigate or from a prepared or standard sample of a compound that proxies for the analyte. The user may interact with the automated method by indicating which of the various test spectra is optimum, from the user's perspective. The user may base this decision on one or more of various criteria including but not limited to: signal strength, degree of elimination of line splitting, signal to noise ratio, and degree of filtering of low m/z ions. Once the user has made an indication of an optimum test spectrum, the values of $\Delta V_c$ and $\Delta V_d$ that were employed during generation of the indicated optimum spectrum as set as values to be used in the subsequent analysis of the sample. Alternatively, the automated method may itself make an automatic determination, based on quantitative analysis of the digitized mass spectra and similar criteria, of which test spectrum is optimal. In this alternative method, user interaction may not be required or may be limited to confirmation or overriding of the automatically determined optimal mass spectrum.

According to another method in accordance with the present teachings, one or more calibration procedures are carried out by determining optimum values of $\Delta V_c$ and k or $\Delta V_c$ and $\Delta V_d$ for a variety of standard or otherwise characterized samples of compounds of various m/z values. Each such calibration procedure, if there are more than one, may employ samples chosen from one particular class of analytes, such as proteins, nucleic acids, carbohydrates, etc. The spectra obtained during the one or more calibration procedures may be digitized and the resulting digitized spectra may be employed to generate quantitative measures of the quality of each spectrum from the digitized mass spectra. The quantitative measures of spectral quality may include assessments of, without limitation: signal strength, degree of elimination of line splitting, signal to noise ratio, and degree of filtering of low m/z ions. Subsequent statistical analysis of the quantitative measures of the spectra obtained during the one or more calibration procedures may then be employed to generate a look-up table of "best" instrument settings (e.g., paired values of $\Delta V_c$ and $\Delta V_d$) for each m/z of each investigated analyte class. Alternatively, the statistical analysis may be employed to generate a regression curve or curves of one or both of $\Delta V_c$ and $\Delta V_d$ versus m/z for each analyte class.

Subsequently, during mass spectral analysis of samples of unknowns by mass spectral scanning, an automated procedure may utilize the look-up table or the regression curve or curves to set or otherwise vary the instrumental settings of $\Delta V_c$ and $\Delta V_d$ in coordination with each particular m/z or m/z range for which data is being acquired such that, at every m/z or m/z range, the deemed optimal values of the instrumental settings, as determined from the one or more calibration procedures, are employed. If the class of the analyte(s) of interest is known in advance of performing the mass spectral analyses of the samples, then the look-up table or look-up table portion or regression curves that is/are employed during the analysis may be specific to that class of analytes, having been generated from data pertaining only to that class of analytes. If the class of the analyte(s) of interest is not known in advance, then instrumental settings at each m/z range may be set according to an average of the best values determined for the various classes of analytes or, alternatively, the automated trial-and-error procedure described in the previous paragraph may be employed. Still further, alternatively, the mass spectral scan may be repeated a plurality of times where, during each repetition, the instrumental settings are set according to a calibration determined for a different respective analyte class.

The discussion included in this application is intended to serve as a basic description. The present invention is not intended to be limited in scope by the specific embodiments described herein, which are intended as single illustrations of individual aspects of the invention, and functionally equivalent methods and components are within the scope of the invention. Various other modifications of the invention, in addition to those shown and described herein will become apparent to those skilled in the art from the foregoing description and accompanying drawings. Such modifications are intended to fall within the scope of the appended claims. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

What is claimed is:

1. A mass spectrometry method comprising:

generating ions including analyte ions using an ion source;

directing the ions into and through an ion guide or a lens element within a first chamber maintained at a first vacuum pressure, the ion guide or lens element maintained at a first offset electrical potential;

transferring the ions into and through an ion guide within a second chamber maintained at a second vacuum pressure that is less than the first vacuum pressure, the ion guide within the second chamber maintained at a second offset electrical potential, wherein a difference between the first and second offset electrical potentials imparts kinetic energy to the ions that causes the ions to fragment by collision-induced dissociation within the second chamber so as to dislodge and remove adduct species from the analyte ions; and transferring the analyte ions into an ion guide within a third chamber maintained at a third vacuum pressure that is less than the second vacuum pressure, the ion guide within the third chamber maintained at a third offset electrical potential, wherein a difference between the third and second offset electrical potentials reduces a portion of the imparted kinetic energy of analyte ions passing into the third chamber from the second chamber.

2. A mass spectrometry method as recited in claim 1, wherein values of the first, second and third offset electrical potentials are chosen so as to correspond, respectively, to the first, second and third offset electrical potential settings employed during acquisition of a prior test spectrum indicated by a user as an optimal spectrum.

3. A mass spectrometry method as recited in claim 1, wherein the transferring of the analyte ions into the ion guide within the third chamber comprises:

passing the analyte ions through an ion lens disposed between the second and third chambers, the lens maintained at a fourth offset electrical potential, wherein a difference between the fourth and second offset electrical potentials causes ions within the ion guide within the second chamber to migrate towards the ion lens.

4. A mass spectrometry method as recited in claim 1, wherein the analyte ions comprise a known mass-to-charge ratio (m/z), and wherein values of the first, second and third offset electrical potentials are determined from a prior mass spectrometer calibration of optimal offset electrical potential settings against variable m/z.

5. A mass spectrometry method as recited in claim 1, wherein the analyte ions comprise a plurality of ion species comprising respective m/z values, the method further comprising:

transferring the analyte ions from the third chamber to a mass filter; and sequentially transferring a plurality of filtered portions of the analyte ion species from the mass filter to a collision cell in the order of the m/z values of the analyte ion species or in the reverse order of the m/z values of the analyte ion species;

wherein the first, second and third offset electrical potentials are caused to vary in coordination with the sequential transferring of the filtered portions of the analyte ions species from the mass filter to the collision cell.

6. A mass spectrometry method as recited in claim 1, further comprising:

transferring the analyte ions from the third chamber to a collision cell; and transferring product ions generated at the collision cell from the collision cell to a mass analyzer.

7. A mass spectrometer system comprising:

an ion source;

first, second and third chambers;

a vacuum system configured to maintain the first, second and third chambers at a first, a second, and a third vacuum pressure, respectively, wherein the first vacuum pressure is greater than the second vacuum pressure and the second vacuum pressure is greater than the third vacuum pressure;

an ion guide or ion lens disposed within the first chamber, an ion guide disposed within the second chamber and another ion guide disposed within the third chamber, respectively;

at least one voltage supply configured to supply first, second and third offset electrical potentials to the ion guide or ion lens with the first chamber, the ion guide within the second chamber and the other ion guide within the third chamber, respectively;

a mass analyzer; and a controller configured to control the values of the supplied first, second and third offset electrical potentials such that a difference between the first and second offset electrical potentials imparts kinetic energy to the ions that causes the ions to fragment by collision-induced dissociation within the second chamber so as to dislodge and remove adduct species from analyte ions and such that a difference between the third and second offset electrical potentials reduces a portion of the imparted kinetic energy of analyte ions passing into the third chamber from the second chamber.

8. A mass spectrometer system as recited in claim 7, wherein the controller is further configured to, when the analyte ions comprise a known m/z value, cause the at least one voltage supply to set the values of the first, second and third offset electrical potentials in accordance with a prior mass spectrometer calibration of optimal offset electrical potential settings against variable m/z.

9. A mass spectrometer system as recited in claim 7, wherein the controller is further configured to:

cause the mass analyzer to generate a set of test mass spectra of a sample, wherein one or more of the first, second and third offset electrical potentials are varied between consecutive test mass spectra;

provide the test mass spectra to a user for evaluation;

receive an indication from the user of an optimal test spectrum; and generate a mass spectrum of a sample of an unknown composition using settings of the first, second and third offset electrical potentials corresponding to the user-indicated optimal test spectrum.

10. A mass spectrometer system as recited in claim 7, further comprising:

an ion lens disposed between the second and third chambers, wherein the controller is further configured to supply a fourth offset electrical potential to the lens such that a difference between the fourth and second offset electrical potentials causes ions within the ion guide within the second chamber to migrate towards the ion lens.

11. A mass spectrometer system as recited in claim 7, wherein the controller is further configured to:

when the analyte ions are positively charged:

cause the at least one voltage supply to cause the supplied third offset electrical potential to be less than the supplied first offset electrical potential; and cause the at least one voltage supply to cause the supplied second offset electrical potential to be less than the supplied third offset electrical potential; and when the analyte ions are negatively charged:

cause the at least one voltage supply to cause the supplied third offset electrical potential to be greater than the supplied first offset electrical potential; and cause the at least one voltage supply to cause the supplied second offset electrical potential to be greater than the supplied third offset electrical potential.

* * * * *